US011458063B1

(12) United States Patent
Miller

(10) Patent No.: US 11,458,063 B1
(45) Date of Patent: Oct. 4, 2022

(54) ORTHOPEDIC POSTURE IMPROVEMENT DEVICE

(71) Applicant: Bruce Wayne Miller, Naples, FL (US)

(72) Inventor: Bruce Wayne Miller, Naples, FL (US)

( * ) Notice: Subject to any disclaimer, the term of this patent is extended or adjusted under 35 U.S.C. 154(b) by 0 days.

(21) Appl. No.: 17/505,784

(22) Filed: Oct. 20, 2021

(51) Int. Cl.

| | |
|---|---|
| ***A61H 23/00*** | (2006.01) |
| ***A61H 1/02*** | (2006.01) |
| ***A61H 23/02*** | (2006.01) |
| ***A63B 21/00*** | (2006.01) |

(52) U.S. Cl.
CPC ..... *A61H 1/0292* (2013.01); *A61H 23/02* (2013.01); *A63B 21/00192* (2013.01); *A61H 2201/1269* (2013.01); *A61H 2201/1685* (2013.01)

(58) Field of Classification Search
CPC ..... A61H 1/0292; A61H 15/00; A61H 15/02; A61H 2015/0014; A61H 2015/0021; A61H 2015/0057; A61H 2015/0092
See application file for complete search history.

(56) References Cited

U.S. PATENT DOCUMENTS

| | | | | |
|---|---|---|---|---|
| 4,935,972 | A * | 6/1990 | Brady | A47C 27/081 4/575.1 |
| 6,065,210 | A * | 5/2000 | Bove | A61H 15/0092 29/895.21 |
| 6,193,678 | B1 * | 2/2001 | Brannon | A61H 23/0263 601/15 |
| 6,626,341 | B2 * | 9/2003 | Mitchell | A45F 3/04 224/576 |
| 6,763,525 | B1 * | 7/2004 | Spector | A61H 39/04 2/115 |
| 9,463,133 | B2 * | 10/2016 | Rodgers | A61H 15/0092 |
| 2002/0193714 | A1 * | 12/2002 | Pecora | A61H 15/00 601/121 |
| 2013/0178768 | A1 * | 7/2013 | Dalebout | A61H 15/0092 601/46 |
| 2013/0231594 | A1 * | 9/2013 | Bennett | A61F 7/02 601/19 |
| 2017/0007495 | A1 * | 1/2017 | Norwood | A61H 15/00 |
| 2018/0049941 | A1 * | 2/2018 | Venezia | A61H 15/02 |
| 2020/0078590 | A1 * | 3/2020 | Bachinski | A61N 1/0456 |
| 2021/0113426 | A1 * | 4/2021 | Marton | A61H 15/00 |

FOREIGN PATENT DOCUMENTS

| | | | | |
|---|---|---|---|---|
| WO | WO-2011013094 | A1 * | 2/2011 | A61H 15/0092 |

* cited by examiner

*Primary Examiner* — LaToya M Louis
(74) *Attorney, Agent, or Firm* — Tiffany C. Miller; Inventions International Inc.

(57) ABSTRACT

A posture improvement device having a material layer with a substantially central bore. A first rod is retained in the substantially central bore of the material layer. The first rod has a substantially central bore configured to receive a second rod. The first rod is configured to be oriented perpendicular to a user's spine during use to improve posture. The second rod is made of a substantially rigid material. The second rod is retained in the substantially central bore of the first rod. The first rod and the second rod are oriented in a nested configuration configured to increase rigidity. A removable barrier element is configured to retain the material layer and is configured to close and open with a fastener.

16 Claims, 7 Drawing Sheets

ORTHOPEDIC POSTURE IMPROVEMENT DEVICE

BACKGROUND OF THE INVENTION

1. Field of the Invention

This invention relates, generally, to an orthopedic posture improvement device. More particularly, it relates to an orthopedic posture straightening device having a foam roller with interchangeable support rods configured to meet the needs of a diverse range of spinal conditions in physical therapy, injury prevention, posture improvement, and fitness applications.

2. Background Art

A current problem exists when individuals exhibit poor posture in which their spine has lateral curvature and/or when their legs have a substantial angulation in the areas of the knees and ankles. Further, poor posture is characterized by a substantially non-S-shaped spine because the pressure on the intervertebral discs of an individual's spine from both body weight and lower body joints are not uniformly distributed. As a result of poor posture, it is well known that many individuals may experience a decrease in their range of motion, body aches, decreased lung capacity, and/or a hunched-over body position. Thus, there is a need for an orthopedic posture improvement device configured to maintain a healthy S-shaped posture of the spine by the training and development of many body muscles when moving, sitting, and/or standing. In particular, there is a need for an orthopedic posture improvement device configured to train an individual's body and to incorporate into their muscle and ligament memory the position of the corrected spine during use.

In particular, many organs and an individual's breathing mechanism may be crowded as a result of the thoracic spine being abnormally curved forward. Further, there is a need for a device capable of improving an individual's posture that may be adjusted to meet an individual's physiological needs such as their age, spine length, and muscular development in physical therapy, injury prevention, and fitness applications. Further, there is a need for a posture improvement device to be adjustable to meet the needs of an individual as they either progress with gaining better posture or as their posture condition deteriorates with for example, disease progression. It would be more desirable for a posture improvement device to allow an individual that has been, for example, has experienced prolonged sitting at a desk during work or sitting in front of a video game to straighten and stretch the muscles and ligaments of the spine. As a result of the straightened and stretched spine, an individual may have deeper breaths, better health, and a longer life.

Many posture improvement devices in today's market are configured to be worn as a garment by a user for neuromuscular stimulation as it pertains to body alignment and posture to the thoracic spine. For example, U.S. Pat. No. 10,849,779 teaches a posture improvement garment configured to be worn by an individual and retaining an individual's torso and their upper arms similar to a shirt. This form fitting shirt has a proprioceptive panel with a dense elastomeric material configured to apply pressure to an individual's skin. Although this posture garment applies pressure to an individual's torso, it would be more desirable for the posture improvement device to have a heating element and a vibration function for a more beneficial treatment.

There are many known back massage devices, exercise devices, and spinal alignment devices are configured to apply pressure to a user's spine for a therapeutic benefit of alleviating pain, building muscle, and improving posture. It is clear that many of these known devices simply teach a rod surrounded by a layer of foam padding. For example, U.S. Pat. No. 10,772,789 teaches a massage device having a cross bar and a roller. The massage element is a roller having a cover with knobs/and or probes protruding from the cover. In another example, U.S. Patent Pub. No. 2005/0215928 teaches a back muscle rollover device having a cylindrical hard inner core made of metal, plastic, PVC, or other firm or semi firm material. The core can be hollow or solid and must be covered by a foam-type sleeve of protective padding. Further, U.S. Patent Pub. No. 2009/0112137 discloses an exercise device having at least one axel with a roller configured to support a user while lying on their back on top of the plurality of rollers during use. Another physiotherapeutic device is taught in U.S. Pat. No. 3,750,654 and has a roller with a central part with two bulbous ridges defining a groove configured to receive a spinal column. U.S. Pat. No. 3,842,453 shows a posture pillow having a hard rubber core and a flexible material of rubber foam surrounding the core. U.S. Pat. No. 3,719,185 teaches an orthopedic pillow having a tubular core with a layer of padding material. Further, U.S. Pat. No. 3,419,268 discusses a cushion and exerciser having a substantially cylindrical core, hard, rigid core with a first layer of soft material surrounding the core, and a second layer of soft material surrounding the first layer of material. U.S. Patent Pub. No. 2002/0193714 teaches a therapeutic device having a hard cylindrical body wrapped in a cushioning sleeve.

There are many physical therapy devices describing a rod with a layer of padding as a therapeutic device, an exercise apparatus, a massage device, and/or a posture pillow. These devices are made of a substantially rigid core surrounded by a soft foam layer. However, it would be more desirable for a foam roller kit having interchangeable rods of varying rigidity to serve as a universal posture device. A universal posture device has the structural adjustability to be configured to have more or less rigidity for the individual's customized pressure setting for a predetermined spinal posture alignment.

However, in view of the prior art considered as a whole at the time the present invention was made, it was not obvious to those of ordinary skill in the pertinent art how the identified needs could be fulfilled.

SUMMARY OF THE INVENTION

The long-standing but heretofore unfulfilled need for a posture improvement device having a layer of foam material surrounding at least one removable rod. A plurality of removable rods may vary in rigidity for application of varied pressure when positioned perpendicular to a user's spine when in use, and which also includes improvements that overcome the limitations of prior art posture improvement devices is now met by a new, useful, and non-obvious invention.

It is within the scope of this invention for a posture improvement device to have a material layer with a substantially central bore. A first rod is retained in the substantially central bore of the material layer. The first rod has a substantially central bore configured to receive a second rod. The first rod is configured to be oriented perpendicular to a user's spine during use to improve posture. The second rod is made of a substantially rigid material. The second rod is retained in the substantially central bore of the first rod. The first rod and the second rod are oriented in a nested configuration configured to increase rigidity. A removable barrier element is a removable and washable cover that retains the material layer and is configured to close and open with a fastener.

In a preferred embodiment, the posture improvement device has a material layer. The material layer is made of any deformable material such as polyethylene foam, gel, foam, plastic, rubber. The material layer houses the components of the posture improvement device and the material layer serves to provide a soft comfort layer to a user during use. For example, when the posture improvement device is oriented perpendicular to a user's spine and is pressed against a user's spine with the force of a user's arms, a soft foam layer is more desirable when directly contacting against a user. However, the foam material layer alone does not provide the rigidity capable of improving posture. A plurality of interchangeable rods are configured to be oriented in a nested configuration and retained within a compartment of the material layer. The material layer has a substantially central bore. A first rod is retained in the substantially central bore of the material layer. The first rod may be solid or have a hollow core capable of receiving another rod and/or weighted pellets. It is within the scope of this invention for the plurality of rods to be made of any material including, but not limited to, polyvinylchloride, wood, metal, plastic, a spring, or rubber. The first rod is made of a substantially rigid material. The first rod can have a substantially central bore configured to receive a second rod. The second rod can be made of a substantially rigid material. The plurality of rods may vary in rigidity and be nested together to form a unique rigidity ideal for a user's specific posture improvement goal. The second rod may have a compartment. The second rod is retained in the substantially central bore of the first rod.

In an alternate embodiment, the compartment of the second rod may retain a plurality of pellets. The plurality of pellets can be magnetic. The pellets may vary in weight to achieve a desired firmness, and/or enhance rigidity, and/or to add weight during strength training. In an example, if the second rod is made of a magnetic material that corresponds to the magnetic properties of the magnetic pellets retained within the second rod, the magnetic field created during this interaction may contribute to therapeutic benefits including, but not limited, to alleviation of pain, improved circulation, and stimulation of spinal cord sensory axons.

In another alternate embodiment, the posture improvement device may have a material layer of polyethylene foam and a single or a first rod only or a plurality of rods. The first rod may have a compartment retaining a plurality of pellets. Further, either the material layer or the first rod or at least one of a plurality of rods may have a power source electrically connected to a switch. At least a portion of the switch is located on an outer portion of the posture improvement device to be accessible to a user to manually switch the electronic components "on" and/or "off". In particular, the electronic components include, but are not limited to, a heating element and/or a vibration element. The power source includes, but is not limited to, a battery. The power source is electrically connected with a wired cord or with a wireless connection. The power source is electrically connected to a heating element. The heating element is capable of generating and emitting heat from the posture improvement device to a user during use. The power source is electrically connected to a vibration element including, but not limited to a DC vibration motor such as iron core, coreless, brushless, piezo, solenoid, or linear resonant actuator.

In yet another embodiment, the posture improvement device may have a push latch mechanism having at least one protruding structure. The push latch mechanism may be retained in the material layer, the first rod, the second rod, and/or traversing through all of the layers and/or rods. At least one protruding structure is configured to extend from, in an outward direction and toward a user, beyond the material layer when a push latch mechanism is disengaged. At least one protruding structure is configured to retract within the posture improvement device so that at least one protruding structure is level and flush with the outermost surface, such as the material layer, of the posture improvement device when a push latch mechanism is engaged. In yet another embodiment, the material layer is retained in a compartment of a removable sleeve or cover. The removable sleeve has a fastener including, but not limited to, a zipper, a button, a tie, a snap, or a magnetic closure, configured to enclose the material layer. The removable sleeve may be water resistant and may be washable to provide a sanitary barrier between users during use.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Figure 1:
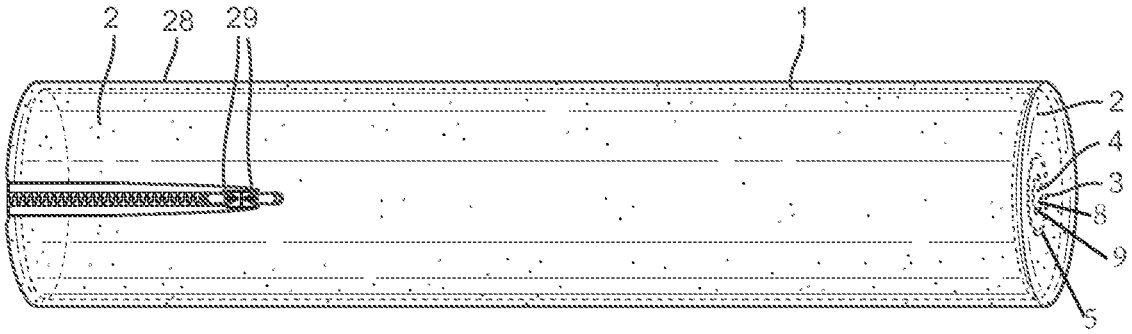
FIG. 1 is a front perspective view of the novel posture improvement device having a removable barrier element.
Figure 2:
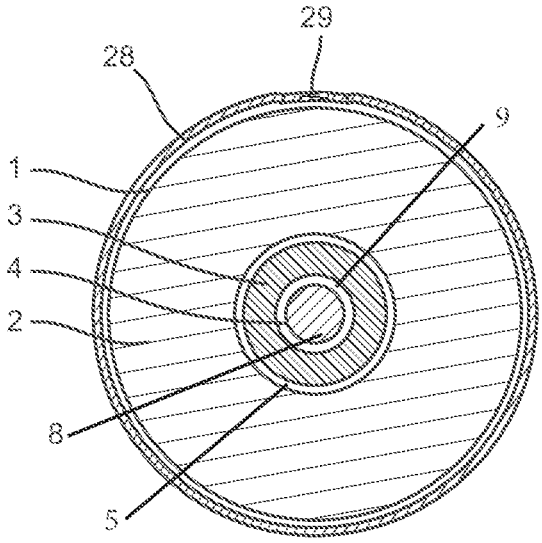
FIG. 2 is a left side cut-away view of the novel posture improvement device having a removable barrier element, a material layer, a first rod, and a second rod.
Figure 3:
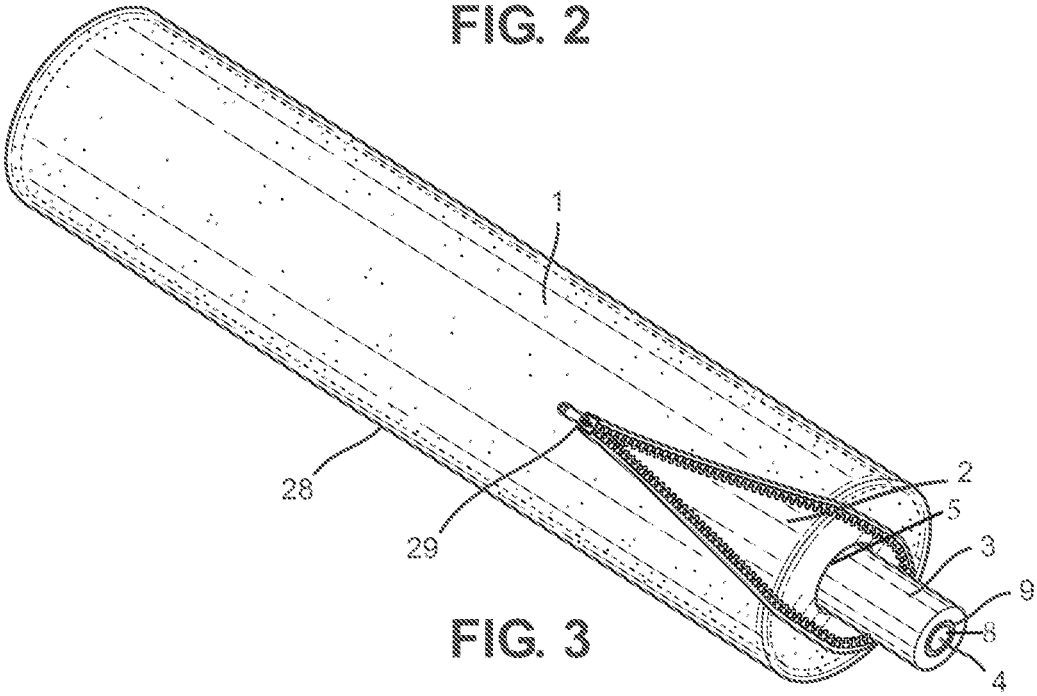
FIG. 3 is a left-perspective view of the novel posture improvement device having a removable barrier element, a material layer, a first rod, and a second rod.

FIGS. 1-10 illustrate a first embodiment of posture improvement device 1, having material layer 2. Material layer 2 has a substantially central bore 5. First rod 3 is retained in substantially central bore 5 of material layer 2. First rod 3 has substantially central bore 9 configured to receive second rod 4. Second rod 4 has compartment 8. Second rod 4 is retained in substantially central bore 9 of first rod 3. FIGS. 1-3 show an alternate embodiment of posture improvement device 1 having material layer 2 being retained in a compartment of removable sleeve 28 which is also referred to as removable barrier element 28. Removable sleeve 28 has at least one fastener 29 configured to enclose material layer 2 within said compartment of said removable sleeve.

Figure 4:
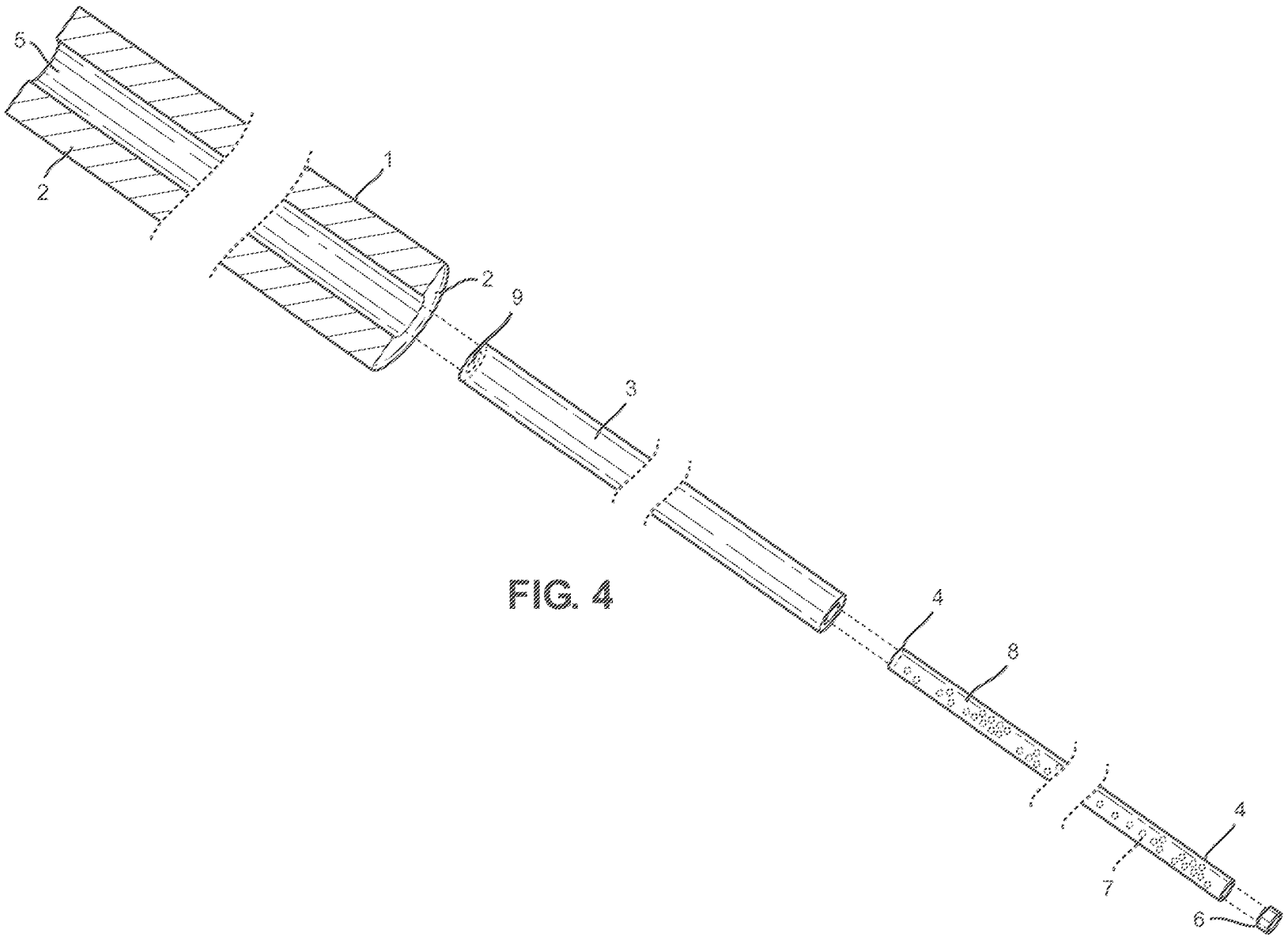
FIG. 4 is an exploded cut-away view of the novel posture improvement device having a material layer, a first rod, and a second rod retaining a plurality of pellets.
Figure 5:
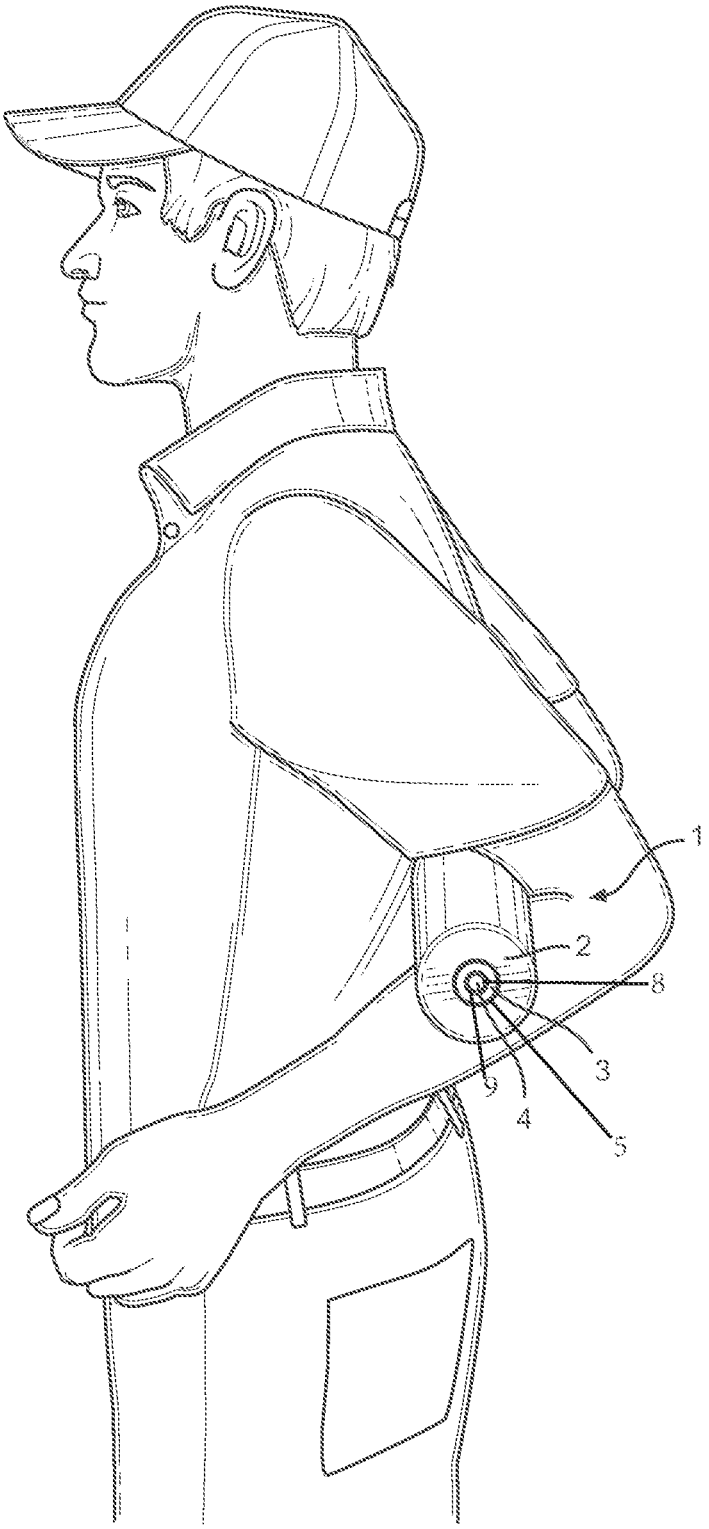
FIG. 5 is a right side perspective view of the novel posture improvement device having a material layer, a first rod, and a second rod.
Figure 6:
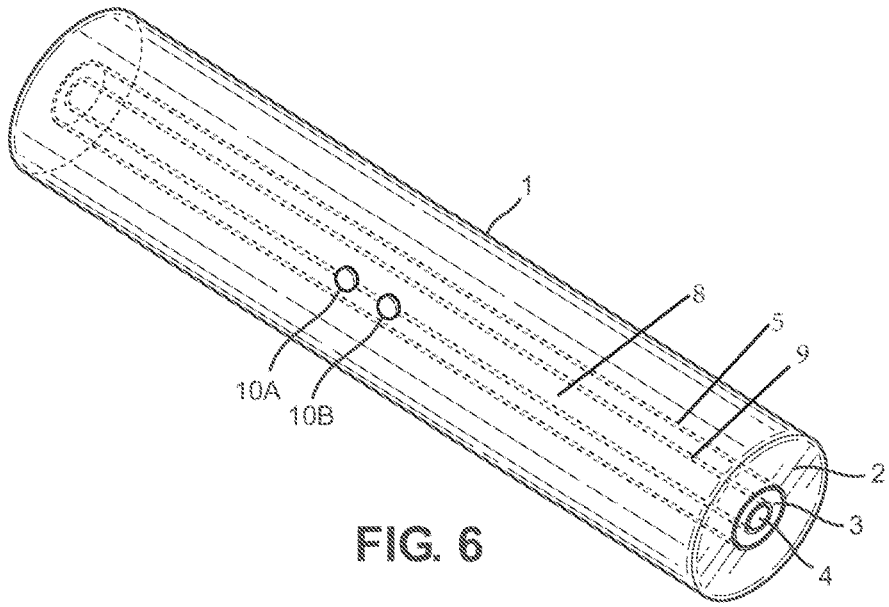
FIG. 6 is a right perspective view of an alternate embodiment of the novel posture improvement device having a material layer, a first rod, a second rod, and protruding structures.
Figure 7:
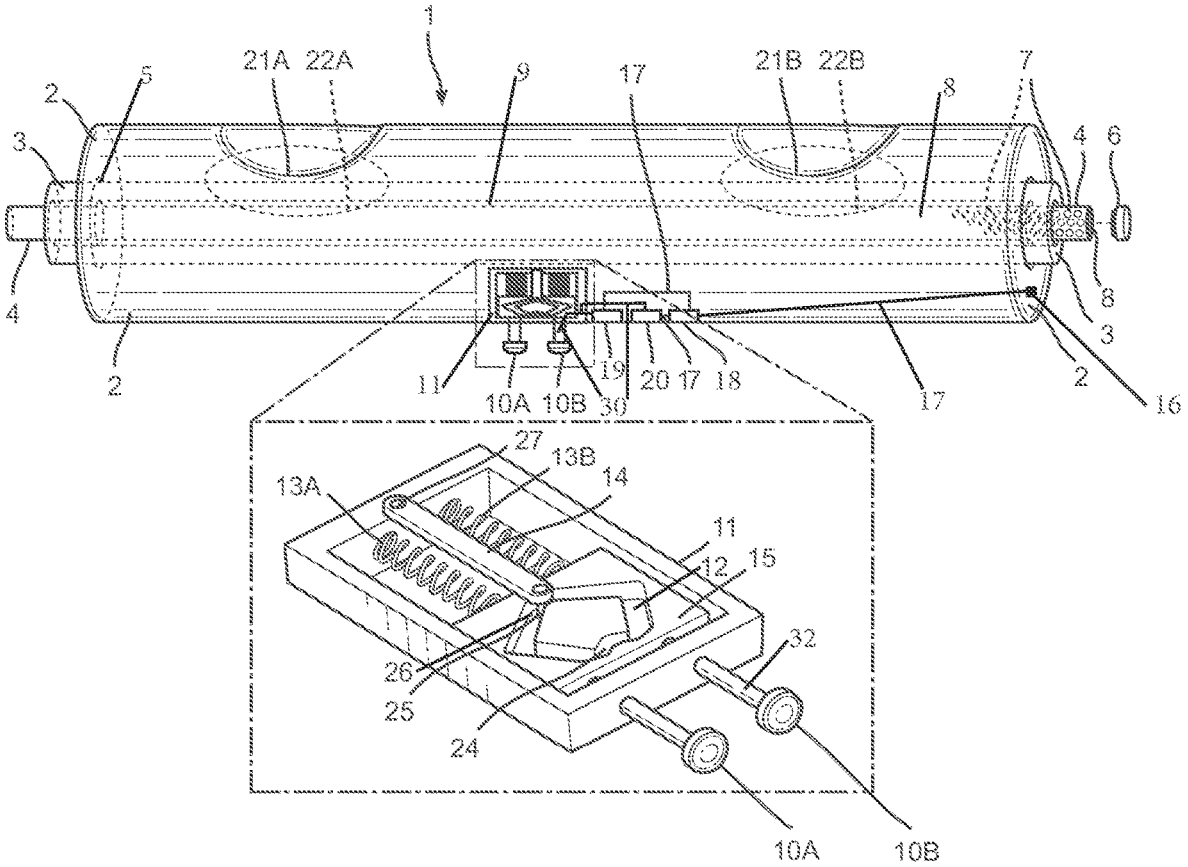
FIG. 7 is a front exploded view of an alternate embodiment of the novel posture improvement device having a material layer, a first rod, a second rod, a plurality of pellets, arm recesses, a power source, a vibration element, a heating element, and a push latch mechanism having a disengaged orientation with protruding structures extending from the material layer.
Figure 9:
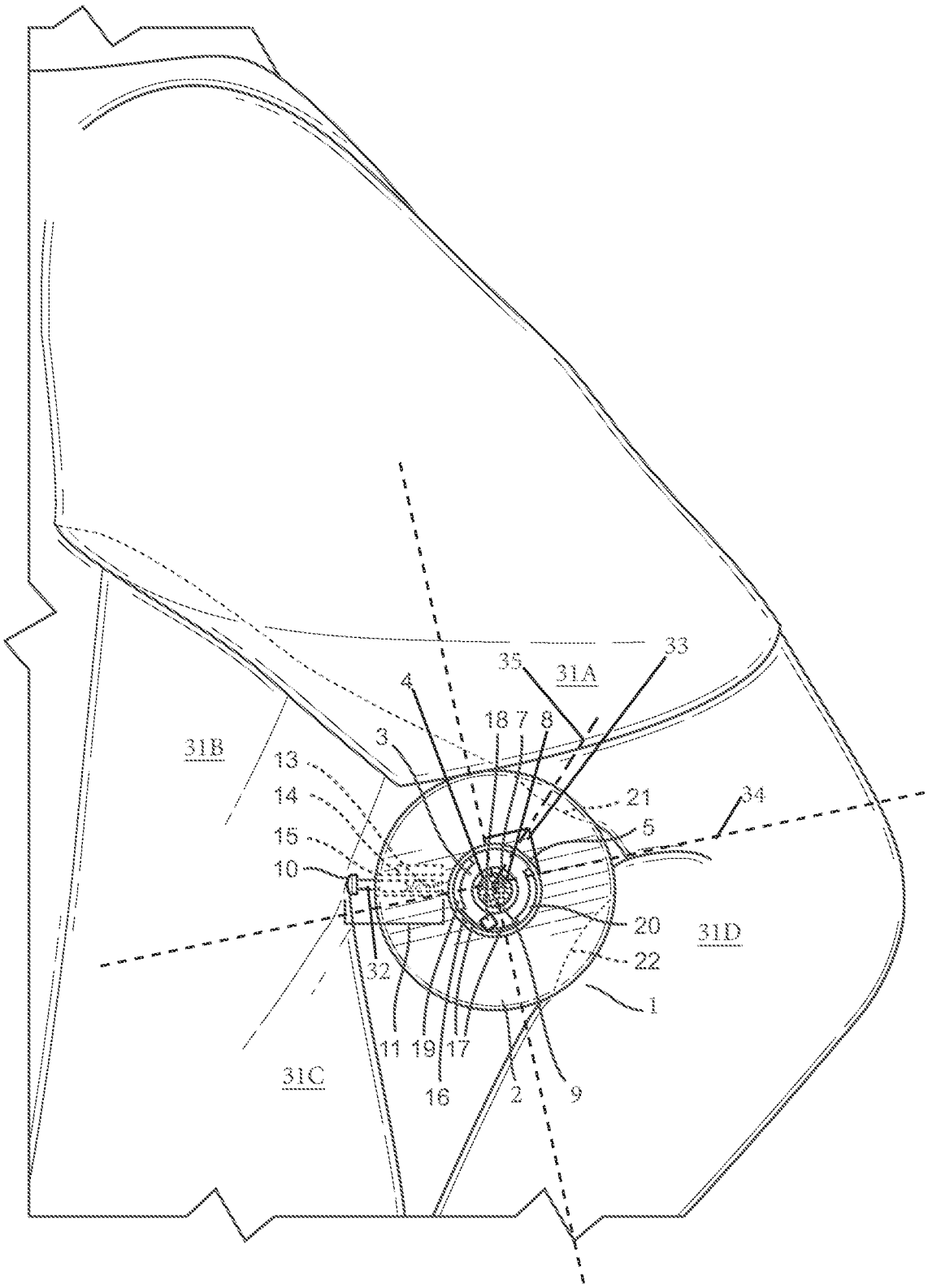
FIG. 9 is a right side view of an alternate embodiment of the novel posture improvement device having a material layer, a first rod, a second rod, a plurality of pellets, arm recesses within corresponding graph coordinates, a power source, a vibration element, a heating element, and a push latch mechanism having a disengaged orientation with protruding structures extending from the material layer; and, FIG. 10 is a right exploded view of an alternate embodiment of the novel posture improvement device having a material layer, a first rod, a second rod, a plurality of pellets, arm recesses, a power source, a vibration element, a heating element, and a push latch mechanism having an engaged orientation with protruding structures retracted into and level with the material layer.
Figure 10:
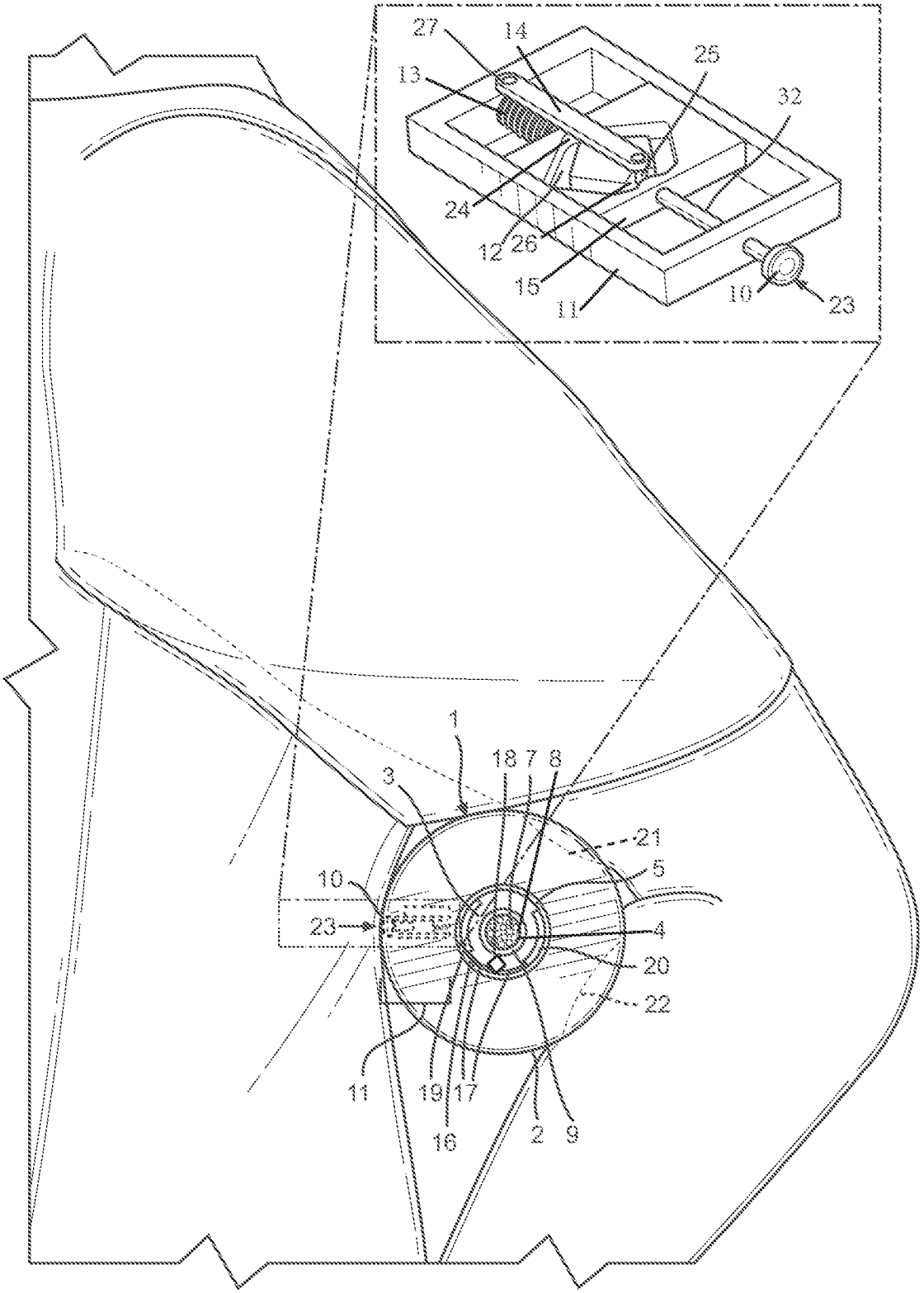

FIGS. 4, 7, and 9-10 depict an alternate embodiment of posture improvement device 1 having compartment 8 of second rod 4 retaining plurality of pellets 7. It is within the scope of this invention for plurality of pellets 7 to be magnetic such as ball magnets. FIGS. 4 and 7 show lid 6 removably connects to an end of second rod 4 to prevent plurality of pellets 7 from being inadvertently expelled from second rod 4 during use. As shown in FIGS. 9 and 10, heating element 19 and vibration element are positioned on either side of second rod 4 retaining plurality of pellets 7 to evenly distribute the heat and vibration to pellets 7.

Figure 8:
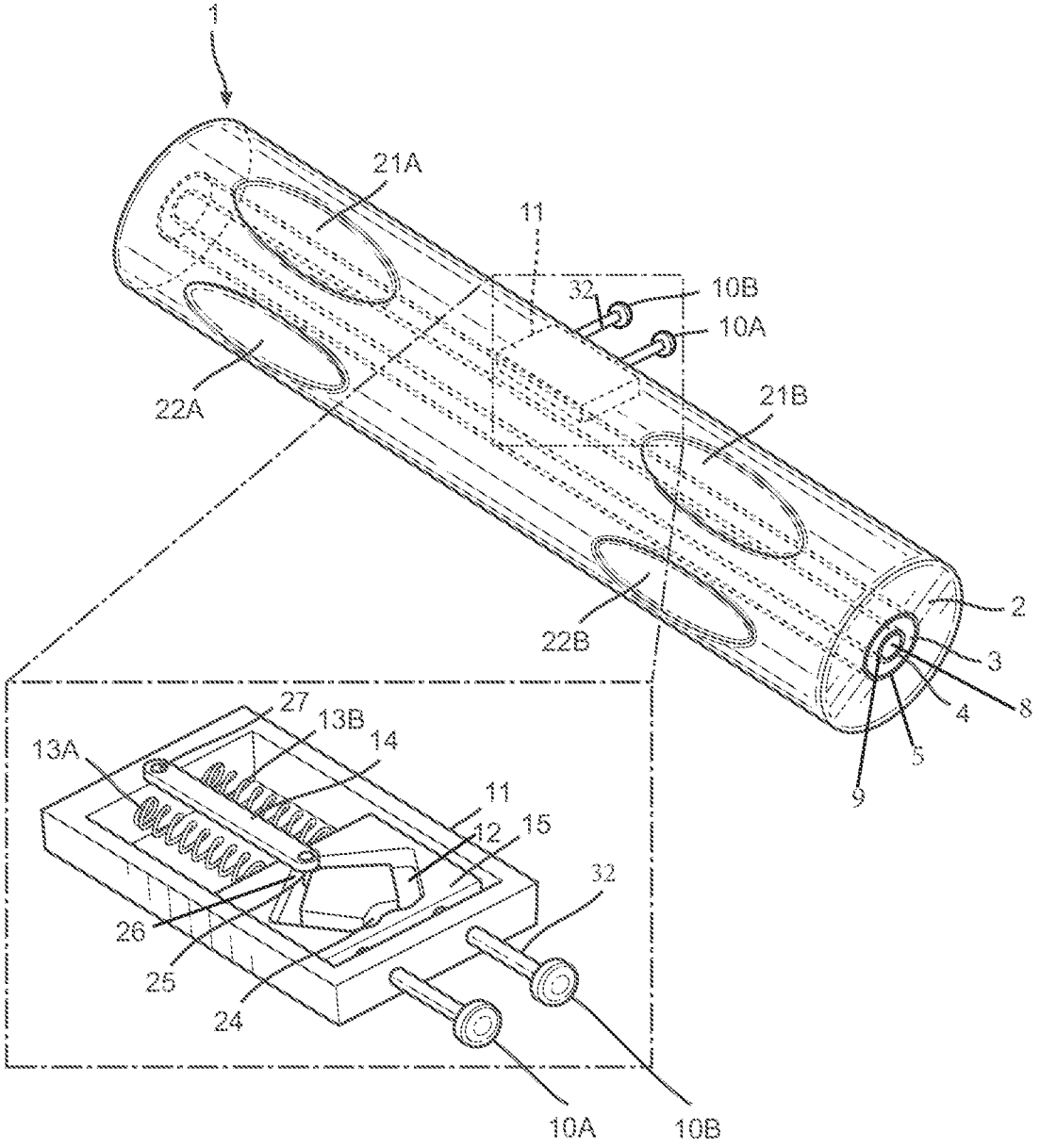
FIG. 8 is a right exploded view of an alternate embodiment of the novel posture improvement device having a material layer, a first rod, a second rod, arm recesses, and a push latch mechanism having a disengaged orientation with protruding structures extending from the material layer.

FIGS. 6-10 illustrate an alternate embodiment of posture improvement device 1 having a latching mechanism with at least one protruding structure 10. FIGS. 7-10 show rod 32 having one end connected to slidable plate 15 located opposite another end connected to at least one protruding structure 10A and/or 10B. Protruding structures 10A and 10B are configured to contact a user's back and apply pressure points when posture improvement device 1 is in use. Mechanical components of latching mechanism 11 are best show in FIGS. 7-10. FIG. 7 shows push latch mechanism 11 having protruding structures 10A and 10B. Protruding structures 10A and 10B are extended beyond material layer 2 when push latch mechanism 11 is disengaged when at least one spring 13 is not compressed. When a user pushes or depresses protruding structure 10A or 10B, hingedly pivotable latch 14 toggles back and forth between first capture recess 24 and second capture recess 26, which are located opposite each other. Hingedly pivotable latch 14 has hinge 27 located opposite protrusion 25. Protrusion 25 traverses or travels along recessed track 12 of slidable plate 15. FIGS. 7-9 best illustrate protrusions 10A and 10B being oriented in an extended position when resilient members 13A and 13B, such as at least one spring, are not compressed by plate 15 when protrusion 25 of hingedly pivotable latch 14 is positioned in second capture recess 26.

FIG. 10 shows protruding structure 10 is configured to retract when push latch mechanism 11 is engaged when at least one spring 13 is compressed. In particular, protrusion 10 is oriented in a retracted position when a user pushes or depresses 23 protruding structure 10 to move slidable plate 15 to compress resilient member 13. As resilient member 13 is compressed, protrusion 25 of hingedly pivotable latch 14 is positioned and retained in first capture recess 24.

FIGS. 7-10 show another alternate embodiment of posture improvement device 1 with material layer 2 having first set of recesses 21A and 21B located parallel to each other. First set of recesses 21A and 21B are configured to capture a user's biceps during use. Material layer 2 has second set of recesses 22A and 22B located parallel to each other. Second set of recesses 22A and 22B are configured to capture a user's forearm during use. Recesses 21 and 22 help to maintain the alignment of protruding structure 10 to be positioned approximate to a user's spine. FIG. 9 shows graph 34 having a 90° angle 33. Recess 21 is located in quadrant I 31A and recess 22 is located in quadrant IV 31D on quadrant graph 34 to emphasize the location of recess 21 and 22 in relation to protrusion 10 which may be located in quadrant II 31B (FIG. 9), III 31C (not shown), and/or both II 31B and III 31C (not shown). The force of a user's forearm and bicep, while being cradled within recesses 21 and 22 as applied to posture improvement device 1, is sufficient for pressure point application of protruding structure 10 against a user's back during treatment. Recess 21 and recess 22 are concave surfaces of the material layer 2 and are both positioned within 180° of each other within quadrant I 31A and quadrant IV 31D. In an example, the central most portion of recess 21 is oriented at an approximately 45° angle 35 (FIG. 9) in relation to the substantially central portion of second rod 4.

FIGS. 7 and 9-10 illustrate an alternate embodiment of posture improvement device 1 having material layer 2 with electrical components being a power source 18 electrically connected to 17 switch 16. Power source 18 is electrically connected to 17 heating element 19. Power source 18 is electrically connected to 17 vibration element 20. It is within the scope of this invention for power source to include, but not be limited to, a battery.

It is within the scope of this invention for posture improvement device 1 having first rod 3, second rod 4, material layer 2, and/or a combination thereof to retain electrical components being a power source 18 electrically connected to 17 switch 16. Power source 18 is electrically connected to 17 heating element 19. Power source 18 is electrically connected to 17 vibration element 20.

It is within the scope of this invention for posture improvement device 1 having first rod 3, second rod 4, material layer 2, and/or a combination thereof to retain electrical components being power source 18 electrically connected to 17 switch 16. Power source 18 is electrically connected to 17 heating element 19 and vibration element 20. FIG. 7 illustrates heating element 19 is connected to 30 at least one protruding structure 10B and heating element 19 is configured to emit heat from at least one protruding structure 10B to a user's back during use. It is within the scope of this invention for plurality of pellets 7 to absorb heat emitted from heating element 19 which in turn, the plurality of pellets 7 then emit heat along the length of the posture improvement device 1. Vibration element 20 is connected to 30 at least one protruding structure 10B and vibration element 20 is configured to emit vibration from at least one protruding structure 10B to a user's back during use.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

The invention claimed is:

1. A posture improvement device, comprising:

a material layer, said material layer having a substantially central bore;

a first rod, said first rod is retained in said substantially central bore of said material layer; and, a push latch mechanism, comprising:

a rod, said rod having one end connected to a slidable plate located opposite another end connected to at least one protruding structure of said rod, said at least one protruding structure of said rod is configured to contact a user's back and apply pressure points when said posture improvement device is in use;

said slidable plate having a recessed track, said recessed track having a first capture recess located opposite a second capture recess;

a resilient member, said resilient member is connected to said slidable plate;

a hingedly pivotable latch having a hinge located opposite a protrusion of said hingedly pivotable latch, said protrusion of said hingedly pivotable latch is configured to traverse along said recessed track of said slidable plate;

said at least one protruding structure of said rod is configured to extend beyond said material layer of said posture improvement device when said push latch mechanism is disengaged, wherein, said at least one protruding structure is oriented in an extended position when said resilient member is not compressed by said slidable plate when said protrusion of said hingedly pivotable latch is positioned in said second capture recess of said slidable plate; and, said at least one protruding structure of said rod is configured to retract when said push latch mechanism is engaged, wherein, said at least one protruding structure is oriented in a retracted position when said resilient member is compressed by said slidable plate when said protrusion of said hingedly pivotable latch is positioned in said first capture recess of said slidable plate.

2. The posture improvement device of claim 1, further comprising:

said material layer is made of a soft material.

3. The posture improvement device of claim 1, further comprising:

said first rod is made of a substantially rigid material.

4. The posture improvement device of claim 1, further comprising:

said first rod having a substantially central bore configured to receive a second rod.

5. The posture improvement device of claim 4, further comprising:

a second rod being made of a substantially rigid material, said second rod having a compartment, said second rod is retained in said substantially central bore of said first rod.

6. The posture improvement device of claim 5, further comprising:

said compartment of said second rod retains a plurality of pellets.

7. The posture improvement device of claim 6, further comprising:

said plurality of pellets are magnetic.

8. The posture improvement device of claim 1, further comprising:

said material layer having a first set of recesses located parallel to each other, said first set of recesses are configured to capture a user's biceps during use, said material layer having a second set of recesses located parallel to each other, said second set of recesses are configured to capture a user's forearm during use.

9. The posture improvement device of claim 1, further comprising:

said first rod having a power source electrically connected to a switch, said power source is electrically connected to a heating element.

10. The posture improvement device of claim 1, further comprising:

said first rod having a power source electrically connected to a switch, said power source is electrically connected to a vibration element.

11. The posture improvement device of claim 1, further comprising:

a power source electrically connected to a switch, said power source is electrically connected to a heating element and a vibration element, said heating element is connected to said at least one protruding structure, said heating element is configured to emit heat from said at least one protruding structure to a user, said vibration element is connected to said at least one protruding structure, said vibration element is configured to emit vibration from said at least one protruding structure to a user.

12. The posture improvement device of claim 1, further comprising:

said material layer is retained in a compartment of a removable sleeve, said removable sleeve has a fastener configured to enclose said material layer within said compartment of said removable sleeve.

13. A posture improvement kit, comprising:

a first rod, said first rod having a substantially central bore configured to receive a second rod, said first rod is configured to be oriented perpendicular to a user's spine during use to improve posture;

said second rod being made of a substantially rigid material, said second rod is retained in said substantially central bore of said first rod; said first rod and said second rod are oriented in a nested configuration configured to increase rigidity; and, a push latch mechanism, comprising:

a rod, said rod having one end connected to a slidable plate located opposite another end connected to at least one protruding structure of said rod, said at least one protruding structure of said rod is configured to contact a user's back and apply pressure points when said posture improvement device is in use;

said slidable plate having a recessed track, said recessed track having a first capture recess located opposite a second capture recess;

a resilient member, said resilient member is connected to said slidable plate;

a hingedly pivotable latch having a hinge located opposite a protrusion of said hingedly pivotable latch, said protrusion of said hingedly pivotable latch is configured to traverse along said recessed track of said slidable plate;

said at least one protruding structure of said rod is configured to extend beyond said material layer of said posture improvement device when said push latch mechanism is disengaged, wherein, said at least one protruding structure is oriented in an extended position when said resilient member is not compressed by said slidable plate when said protrusion of said hingedly pivotable latch is positioned in said second capture recess of said slidable plate; and, said at least one protruding structure of said rod is configured to retract when said push latch mechanism is engaged, wherein, said at least one protruding structure is oriented in a retracted position when said resilient member is compressed by said slidable plate when said protrusion of said hingedly pivotable latch is positioned in said first capture recess of said slidable plate.

14. The posture improvement device of claim 13, further comprising:

a removable barrier element, said removable barrier element is configured to retain said first rod and said second rod, an opening of said removable barrier element is configured to close when a fastener of said removable barrier element is oriented in a closed orientation.

15. The posture improvement device of claim 14, further comprising:

said removable barrier element is polyethylene foam.

16. The posture improvement device of claim 13, further comprising:

said push latch mechanism having at least one protruding structure, said at least one protruding structure is configured to extend beyond said removable barrier element when said push latch mechanism is disengaged, said at least one protruding structure is configured to retract when said push latch mechanism is engaged, a power source is electrically connected to a switch, said power source is electrically connected to a heating element, said power source is electrically connected to a vibration element, said heating element is connected to said at least one protruding structure, said heating element is configured to emit heat from said at least one protruding structure to a user, said vibration element is connected to said at least one protruding structure, said vibration element is configured to emit vibration from said at least one protruding structure to a user.

* * * * *